US009741285B2

(12) United States Patent
Hong

(10) Patent No.: US 9,741,285 B2
(45) Date of Patent: Aug. 22, 2017

(54) REPAIRABLE ORGANIC LIGHT-EMITTING DISPLAY APPARATUS AND METHOD OF REPAIRING THE SAME

(71) Applicant: Samsung Display Co., Ltd., Yongin, Gyeonggi-Do (KR)

(72) Inventor: Sang-Min Hong, Yongin (KR)

(73) Assignee: Samsung Display Co., Ltd. (KR)

( * ) Notice: Subject to any disclaimer, the term of this patent is extended or adjusted under 35 U.S.C. 154(b) by 614 days.

(21) Appl. No.: 14/040,353

(22) Filed: Sep. 27, 2013

(65) Prior Publication Data

US 2014/0354700 A1 Dec. 4, 2014

(30) Foreign Application Priority Data

May 31, 2013 (KR) ..... 10-2013-0063081

(51) Int. Cl.

*G09G 3/20* (2006.01)
*G09G 3/3233* (2016.01)
*G09G 3/00* (2006.01)

(52) U.S. Cl.

CPC ..... *G09G 3/3233* (2013.01); *G09G 3/006* (2013.01); *G09G 2300/0819* (2013.01); *G09G 2300/0852* (2013.01); *G09G 2300/0861* (2013.01); *G09G 2310/0262* (2013.01); *G09G 2330/04* (2013.01); *G09G 2330/08* (2013.01); *G09G 2330/12* (2013.01)

(58) Field of Classification Search

CPC ..... G09G 3/2003; G09G 3/30; G09G 5/00; H01J 7/44
USPC ..... 345/690, 76, 205; 313/307
See application file for complete search history.

(56) References Cited

U.S. PATENT DOCUMENTS

| | | | | |
|---|---|---|---|---|
| 7,564,452 | B2 * | 7/2009 | Komiya | G09G 3/006 315/169.1 |
| 8,227,977 | B2 * | 7/2012 | Lhee | H01L 51/0021 257/E21.596 |
| 2007/0075936 | A1 * | 4/2007 | Kim | G09G 3/006 345/76 |
| 2009/0204349 | A1 * | 8/2009 | Govil | B81C 99/0045 702/64 |
| 2010/0039016 | A1 * | 2/2010 | Lhee | H01L 51/0021 313/307 |
| 2011/0043499 | A1 * | 2/2011 | Cok | G09G 3/006 345/205 |
| 2013/0134986 | A1 * | 5/2013 | Yun | G09G 3/006 324/543 |

FOREIGN PATENT DOCUMENTS

| | | |
|---|---|---|
| JP | 2005-338532 | 12/2005 |
| KR | 10-1036738 | 6/2005 |
| KR | 10-2006-0114456 | 11/2006 |
| KR | 10-2008-0041015 | 5/2008 |
| KR | 10-0986845 | 10/2010 |

* cited by examiner

*Primary Examiner* — Carolyn R Edwards
(74) *Attorney, Agent, or Firm* — Innovation Counsel LLP

(57) ABSTRACT

An organic light-emitting display apparatus includes a plurality of lines disposed to include crossing points where lines insulated from one another by an insulation layer cross. If a defect occurs at one of the crossing points, the lines may be shorted together and the apparatus malfunctions. A method of identifying a shorted crossing point uses a test light-emitting device that is disposed to correspond to the crossing point and to emit light when a short is present at its corresponding crossing point.

19 Claims, 6 Drawing Sheets

REPAIRABLE ORGANIC LIGHT-EMITTING DISPLAY APPARATUS AND METHOD OF REPAIRING THE SAME

CROSS-REFERENCE TO RELATED PATENT APPLICATION

This application claims the benefit of Korean Patent Application No. 10-2013-0063081, filed on May 31, 2013, in the Korean Intellectual Property Office, the disclosure of which application is incorporated herein in its entirety by reference.

BACKGROUND

1. Field of Disclosure

The present disclosure of invention relates to an organic light-emitting display apparatus and to a method of repairing the same.

2. Description of Related Technology

Thin panel displays (TPD's), and as more specific examples; flat-panel displays (FPD's) may include an organic light-emitting display (OLED) apparatus and/or a liquid-crystal display (LCD) apparatus. Each includes a plurality of display pixels (picture forming elements). Each display pixel includes a pixel circuit (PC) where the latter may include a thin-film transistor (TFT) and a capacitor, and each pixel circuit is connected to a corresponding set data providing and control lines.

As a resolution of a TPD (e.g., an FPD) is increased, the number of lines is increased and often a corresponding degree of circuit miniaturization is increased. Accordingly, as a size of the TPD (e.g., FPD) is increased, a possibility of a short defect or an open defect between its fine pitched lines is increased. Particularly, in the case of mass production of large T/FPD's, the number of individual panels that may be formed on a mother substrate are relatively small. A single defect within a given individual panel may require discard of that panel. If all the mother substrates that each include a defective panel had to be scrapped, production yield as measured on a per pixel basis may be extremely poor. It would be advantageous to have a structure and method of repairing lines, which is especially appropriate for large sized T/FPD's that have relatively high resolutions.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

An organic light-emitting display apparatus in accordance with the present disclosure includes a plurality of fine pitched lines disposed to include crossing points where lines insulated from one another by an insulation layer cross with one another. If a defect occurs at one of the crossing points, the respective lines may be shorted together and the apparatus malfunctions. A method of identifying a shorted crossing point uses a test light-emitting device that is disposed to correspond to a respective crossing point and to emit light when a short is present at its corresponding crossing point. The test light-emitting device is used to identify the location of a shorted crossing point so that the short there at may be repaired. A method of repairing the same includes using a branching around repair line portion.

According to one embodiment, there is provided an organic light-emitting display apparatus including: a plurality of lines disposed to include at least one crossing point; a pixel that includes a pixel circuit that is electrically coupled to the plurality of lines and a pixel light-emitting device that is coupled to the pixel circuit and driven by the pixel circuit, and is disposed to correspond to the crossing point; and a test light-emitting device that is disposed to correspond to the pixel, is electrically coupled to the plurality of lines, and emits light if a short circuit is present at its respective crossing point.

The plurality of lines may include a first line that extends in a first direction and transmits a negative voltage; and a second line that extends in a second direction which crosses the first direction, is formed in a different layer from the first line so as to overlap with the first line at the crossing point, and transmits a positive voltage.

The first line may transmit an initializing voltage that initializes the pixel circuit, and the second line may transmit a data voltage to emit light from the pixel light-emitting device.

The second line may include a repairing line portion that is branched apart from the second line, circumvents the crossing point, and converges back to rejoin the second line.

The first line may be included on a first insulating layer that is formed on a substrate, and the second line may be included on a second insulating layer that is formed on the first insulating layer to cover the first line.

The organic light-emitting display apparatus may further include a test switching device that is included between the plurality of lines and the test light-emitting device and is turned on when a short is present at a respective crossing point.

The test switching device may be a p-channel metal oxide semiconductor (PMOS) transistor in which a gate terminal is coupled to the second line, a source terminal is coupled to a driving voltage line, and a drain terminal is coupled to the test light-emitting device.

The gate terminal may be formed as one body with the second line.

The test switching device and the test light-emitting device may be disposed to overlap with each other.

The test switching device may be turned on, when a short is generated at the crossing point, and thus the negative voltage is applied to the gate terminal.

The pixel light-emitting device may include a pixel electrode, a pixel intermediate layer that includes an organic emissive layer, and an opposite electrode, and the test light-emitting device may include a lower electrode that is formed of the same material and on the same layer as the pixel electrode, and an upper electrode that is formed of the same material and on the same layer as the opposite electrode.

The test light-emitting device may emit light of a same color as that of the pixel light-emitting device.

The test light-emitting device may alternatively emit light of a different color than that of the pixel light-emitting device.

An area of the test light-emitting device may be substantially smaller than that of the corresponding pixel light-emitting device.

According to an aspect of the present disclosure, there is provided a method of identifying shorts in and repairing an organic light-emitting display apparatus having such shorts, wherein the organic light-emitting display apparatus includes a first line that extends in a first direction, and a second line that extends in a second direction which crosses the first direction, is formed in a different layer from that of the first line to overlap with the first line at a crossing point, and includes a repairing line that is branched apart from the second line, circumvents the crossing point, and converges back to rejoin the second line; a pixel that comprises a pixel circuit that is electrically coupled to the first line and the second line and a pixel light-emitting device that is coupled to the pixel circuit and driven by the pixel circuit, and is disposed to correspond to the crossing point; and a test light-emitting device that is electrically coupled to the first line and the second line via a test switching device and is disposed to correspond to the pixel, and thus emits light when a short is present at the crossing point, the method including: transmitting an initializing voltage to the first line; identifying whether and which test light-emitting device emits light, inspecting whether the corresponding crossing point is shorted; and if the crossing point of the test light-emitting device which emits light is shorted, repairing the short of the crossing point by creating open circuits around it and instead using its in parallel and corresponding repairing line portion.

The initializing voltage may be a negative voltage.

The test switching device may be turned on when a short is present at the crossing point and the negative voltage is applied to a gate terminal of the test switching device.

The inspecting of whether the crossing point is shorted may include turning on of the test switching device when a short is generated at the crossing point; emitting light, by the test light-emitting device that is coupled to the turned-on test switching device; and determining that the crossing point, which is coupled to the pixel that corresponds to the test light-emitting device that emits light, is shorted The repairing may include cutting both points of the second line, with the shorted crossing point therebetween.

The cutting may be performed by exposing the both points of the second line to a laser beam.

BRIEF DESCRIPTION OF THE DRAWINGS

The above and other features and advantages of the present disclosure of invention will become more apparent by describing in detail exemplary embodiments thereof with reference to the attached drawings in which.

DETAILED DESCRIPTION

Figure 1:
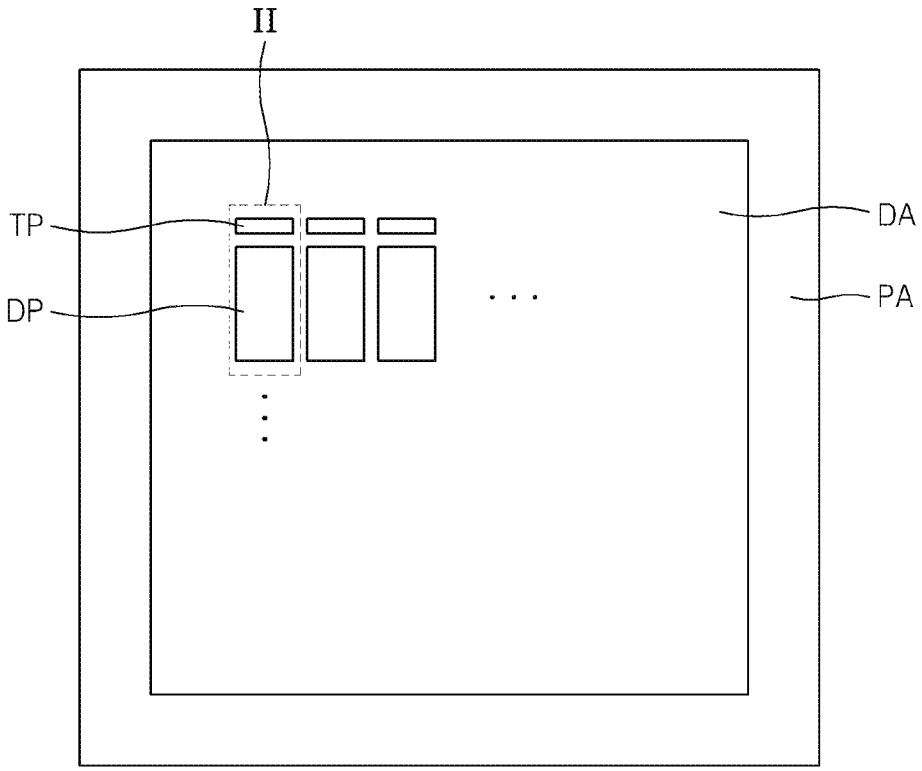
FIG. 1 is a schematic plan view illustrating an organic light-emitting display (OLED) apparatus according to an embodiment of the present disclosure.

In the description of the present teachings, certain well known details of the related art are omitted or briefly provided when it is deemed that they may unnecessarily obscure the essence of the present teachings. In the drawings, the thicknesses of layers and regions may be exaggerated for clarity.

Like numbers refer to like elements throughout the description of the figures. While such terms as "first", "second", etc., may be used to describe various components, such components must not be limited to the above terms. The above terms are used only to distinguish one component from another. It will also be understood that when a layer, a region, or an element is referred to as being "on" another layer, region, or element, it can be directly on the other layer, region, or element, or intervening layers, regions, or elements may also be present.

The present disclosure of invention will now be described more fully with reference to the accompanying drawings, in which exemplary embodiments are shown.

Figure 2:
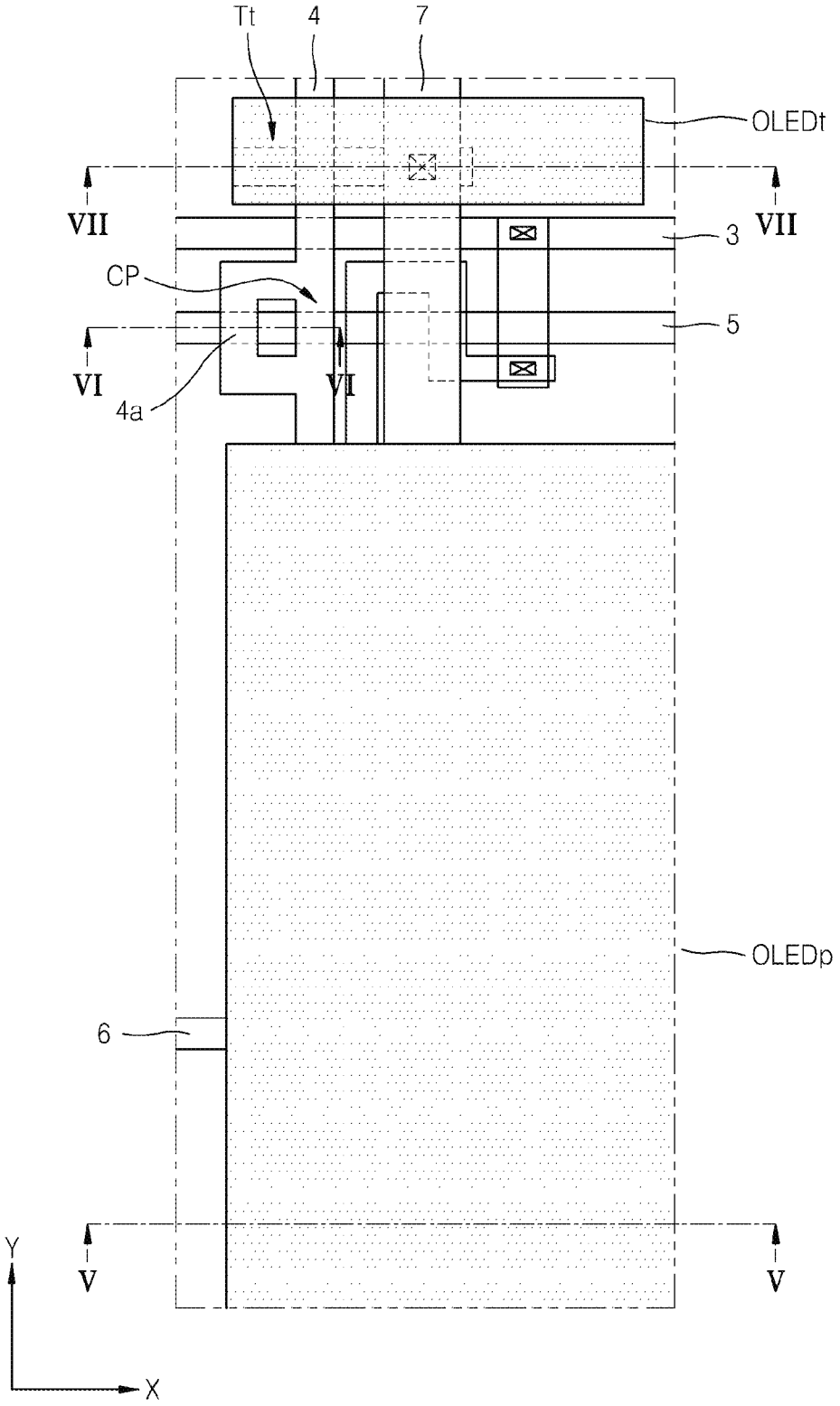
FIG. 2 is a detailed plan view of dashed area II of FIG. 1.
Figure 3:
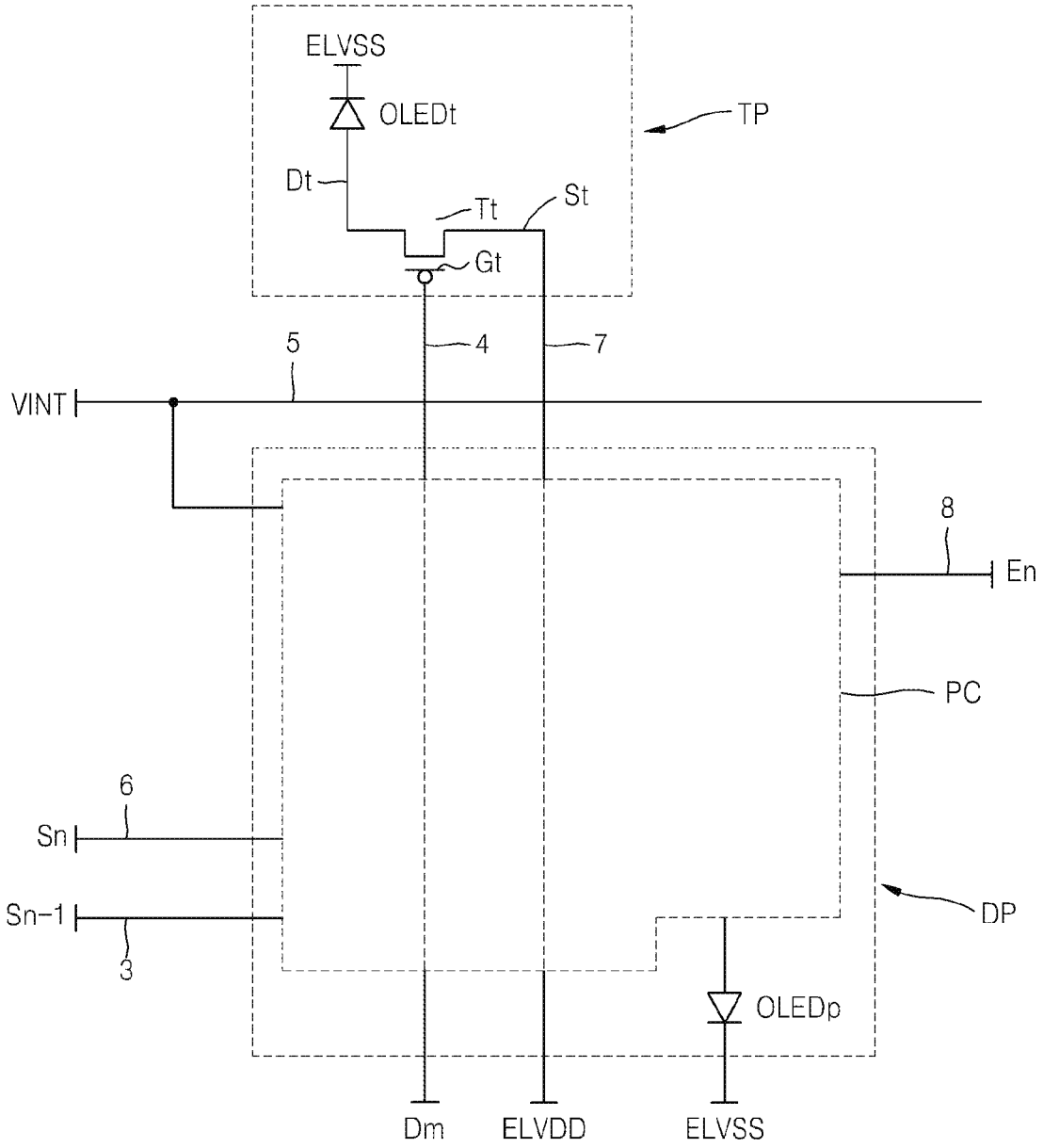
FIG. 3 is a block level, equivalent circuit diagram of FIG. 2.
Figure 4:
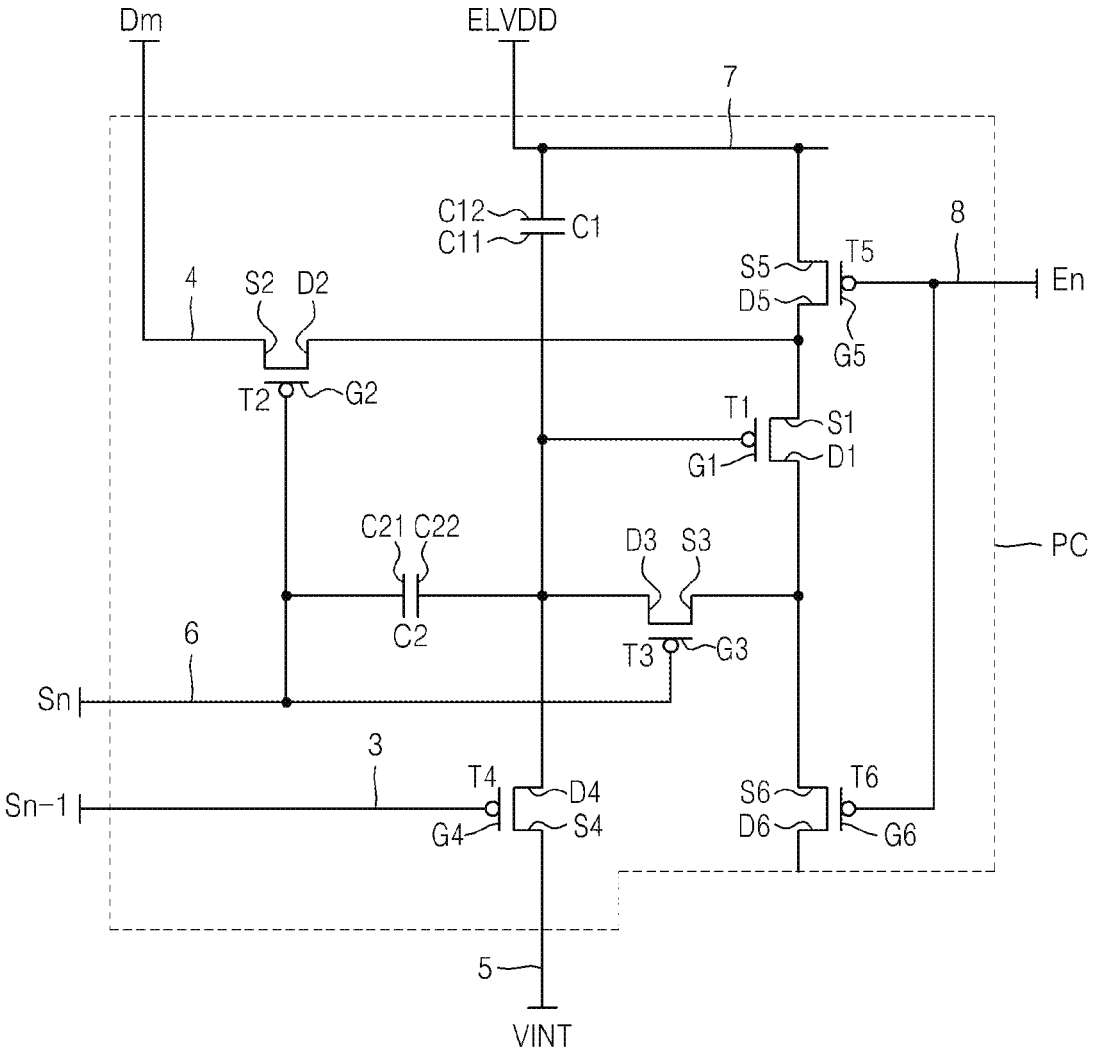
FIG. 4 is a more detailed circuit diagram of area PC of FIG. 3.
Figure 5:
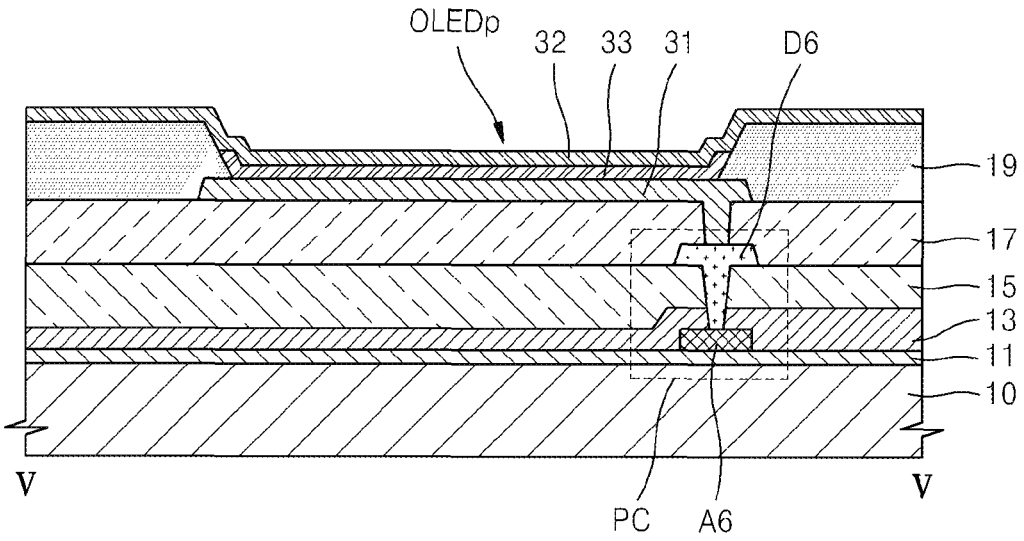
FIG. 5 is a cross-sectional view of the organic light-emitting display apparatus of FIG. 2, taken along line V-V.
Figure 6:
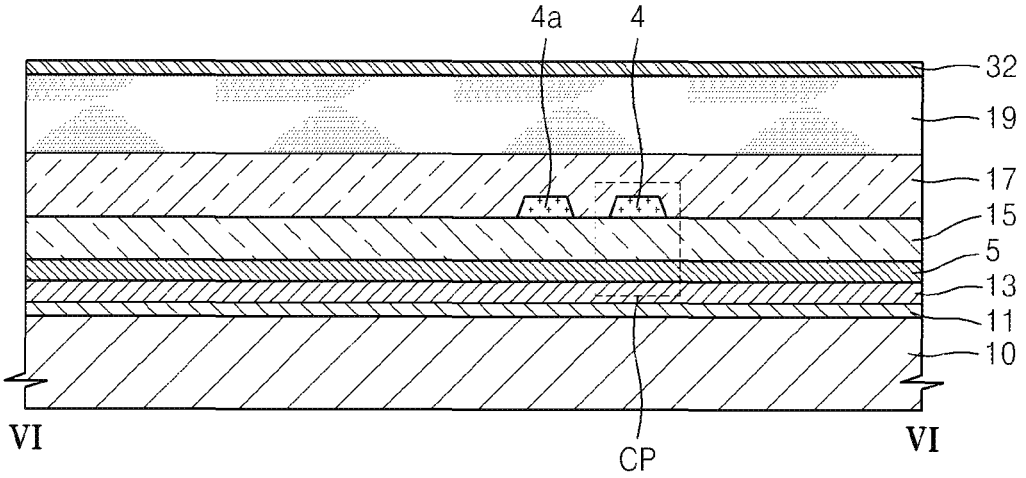
FIG. 6 is a cross-sectional view of the organic light-emitting display apparatus of FIG. 2, taken along a line VI-VI.
Figure 7:
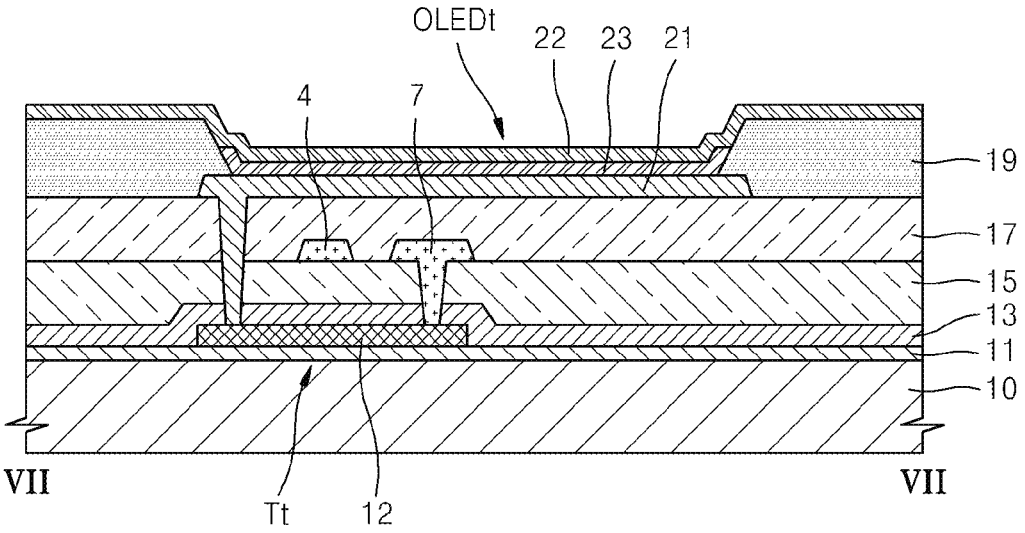
FIG. 7 is a cross-sectional view of the organic light-emitting display apparatus of FIG. 2, taken along a line

FIG. 1 is a schematic plan view illustrating an organic light-emitting display (OLED) apparatus according to an embodiment of the present disclosure. FIG. 2 is a detailed plan view of area II of FIG. 1. FIG. 3 is an equivalent circuit diagram of FIG. 2. FIG. 4 is a detailed circuit diagram of area PC of FIG. 3. FIG. 5 is a cross-sectional view of the organic light-emitting display apparatus of FIG. 2, taken along line V-V. FIG. 6 is a cross-sectional view of the organic light-emitting display apparatus of FIG. 2, taken along line VI-VI. FIG. 7 is a cross-sectional view of the organic light-emitting display apparatus of FIG. 2, taken along line VII-VII.

Hereinafter, referring to FIGS. 1 through 7, a detailed description regarding the organic light-emitting display apparatus of these figures will be provided.

Referring to FIG. 1, the organic light-emitting display apparatus includes a substrate that is partitioned into a display area DA in which an image is displayed, and a peripheral area PA in which an image is not displayed. Provided in the display area DA are a plurality of control and data lines, a plurality of display pixels DP, otherwise referred to as pixels, which are connected to the lines and are configured to form a desired image. Additionally, for each display pixel DP, there is also provided in the display area DA a test pixel TP, which corresponds to its respective display pixel DP, but is not used to form part of a user viewed image, but rather is used to find defects in the lines, as will be detailed below.

The plurality of lines includes first lines and second lines. The first lines refer to lines that extend in a first direction, for example, "an X-direction". The second lines refer to lines that extend in a second direction that crosses the first direction, for example, "a Y-direction". A point at which one of the first lines and one of the second lines cross each other is referred to as a crossing point CP.

The first lines and the second lines are included in different and insulatively separated from one another layers of the substrate. For example, the first lines may be disposed on a first insulating layer 13, shown in FIG. 6, which is formed on the substrate 10. The second lines may be disposed on a higher up, second insulating layer 15, shown in FIG. 6, which covers the first lines (e.g., 5).

More specifically, the first lines include a so-called, initializing voltage line 5. The initializing voltage line 5 receives an initializing voltage $V_{INT}$ from a driving unit (not illustrated) that is disposed in the peripheral area PA, and transmits the initializing voltage $V_{INT}$ to the display area DA. The initializing voltage $V_{INT}$ may be a negative voltage, for example, about −2 V. The first lines may further include a current row scanning line 6 and a previous row scanning line 3, as well as a light-emitting (enabling) control line 8. The row scanning line 6 and the previous row scanning line 3 respectively receive a current row scanning signal Sn and a previous row scanning signal Sn−1 from the driving unit, which unit is disposed in the peripheral area PA. The current and previous row scanning signals, Sn and Sn−1 are provided at a predetermined timing. The driving unit transmits the row scanning signal Sn or Sn−1 to the display pixel DP along corresponding scan lines 6 and 3. The light-emitting control line 8 receives a light-emitting control (enable) signal $E_n$ from the driving unit, and transmits the light-emitting control signal $E_n$ to the display pixel DP. The first lines may further include other lines, in addition to the lines that are described above.

The second lines include a data line 4. The data line 4 receives an analog data voltage Dm from the driving unit that is disposed in the peripheral area PA, and transmits the data voltage Dm to the display pixel DP. The data voltage Dm may be a positive voltage and may range, for example, from about +1.5 V to +4.0 V. The second lines may further include an ELVDD driving voltage line 7. The driving voltage line 7 receives a first power voltage ELVDD from the driving unit, which is disposed in the peripheral area PA, and transmits the first power voltage ELVDD to the display pixel DP. For example, the first power voltage ELVDD may be about +4.6 V. The second lines may further include other lines, in addition to the lines that are described above.

At least one of the first lines and the second lines includes a repairing line portion. FIG. 2 shows that the data line 4 as includes a repairing line portion 4*a*. However, this is only an example, and the present disclosure of invention is not limited this specific example. Any of the first lines may include a repairing line portion. Alternately, any of the second lines, other than the data line, may include a repairing line portion. Referring back to FIG. 2, the repairing line portion 4*a* is branched from the main data line 4, and the repairing line portion 4*a* bypasses the crossing point CP, and then, converges back to the main data line 4. The repairing line portion 4*a* is formed in the same layer as the data line 4, and may be formed as one body with the data line 4.

Per the above definition, a crossing point CP is a place where a short circuit may easily be created as between crossing lines and through the insulation film that separates them. This is true for any lines like the first lines and the second lines, if any of those crossing lines are disposed in different layers separated by an insulation film where a defect may occur in the insulation film. The various crossing lines may extend in different directions. More specifically, if static electricity is generated in a process of manufacturing an organic light-emitting display apparatus, the static electricity may flow via one of the crossing lines (e.g., one of the first lines or the second lines) and through the crossing point CP to the other of the crossing lines, and thereby destroys a portion of the insulation film (e.g., second insulating layer 15) located at the crossing point CP. Thus, the crossing lines (e.g., the first and second lines) may be undesirably electrically shorted due to the static discharge induced defect in the insulation film disposed between the crossing lines.

Static discharge is just one of several ways that a defect can develop during mass production fabrication. As another example, if a foreign object, such as a conductive or resistive dirt particle, is interposed at a crossing between the first lines and the second lines in a process of manufacturing an organic light-emitting display apparatus, a short may be generated between the first lines and the second lines at the crossing point CP. When a short is generated at the crossing point CP, an operational defect is created whereby, due to the defect, the display pixel DP that corresponds to that crossing point CP may not operate normally.

As the organic light-emitting apparatus of modern display systems tends to be large and/or has a high resolution, the separation space between lines is narrowed, and the number of display pixels DP is increased. Accordingly, a possibility of the defect, described above, may be increased. Therefore, in order to increase a yield of a product and prevent an increase in a manufacturing cost, an organic light-emitting display apparatus should be designed so that the above-described defects can be repaired. Thus, according to an embodiment of the present disclosure of invention, there is provided an additional repairing line portion, which is branched around the passing through main line (e.g., one of the second lines), the branching being adjacent to but circumventing the crossing point CP and converging back to the main line. The likelihood that both the repairing line portion (e.g., 4*a*) and the portion of the main line (e.g., 4) that is part of the crossing point CP will both have a short circuit to the crossing other line is small. Therefore, once the location of the short circuit is identified, it is relatively easy to repair the short circuit defect, for example by laser ablation of the short circuited part of the main line. A method of detecting and repairing a short defect at a crossing point CP will be described below with reference to FIG. 7.

When a short circuit defect occurs at a crossing point CP, it may be difficult to identify the location of the defect-containing crossing point CP (the one of many crossing points CP's at which the short defect has occurred). However, according to an embodiment of the present disclosure, a location of the crossing point CP in which a short circuit defect has occurred may be detected by disposing a test pixel TP in correspondence to and adjacent to each respective display pixel DP. After the detecting, the short defect at the corresponding point CP may be repaired with use of the in-parallel, repairing line portion as a means of circumnavigating around the repaired (e.g., ablated) spot.

Hereinafter, referring to FIGS. 2 through 4, the display pixel DP and the test pixel TP, which are connected to lines, are described in detail.

The display pixel DP is connected to a plurality of lines and is disposed to correspond to the crossing point CP. For example, the display pixel DP may be formed to correspond to a point at which the first lines and the second lines cross each other. This is because each of the display pixels DP is connected to both the first lines and the second lines to receive a signal or a voltage. The display pixel DP includes a pixel circuit PC that is electrically connected to a plurality of lines, and a main pixel light-emitting device $OLED_P$ that is connected to the pixel circuit PC and driven by the pixel circuit PC.

In one embodiment, the pixel circuit PC includes at least two switching elements (e.g., transistors) and at least one storage capacitor. FIG. 4 shows that the pixel circuit PC of the exemplary embodiment includes six transistors and two capacitors. Hereinafter, the pixel circuit PC, shown in FIG. 4, is described as an example.

All the transistors included in the exemplary pixel circuit PC are p-channel metal oxide semiconductor (PMOS) transistors, and are structurally thin-film transistors (TFT). As understood by those skilled in the art, an enhancement type PMOS transistor typically becomes conductive when its gate electrode is pulled low relative to its source electrode. In FIG. 4, the set of TFT's includes an OLED driving TFT T1, a pixel selecting or switching TFT T2, a compensation TFT T3, an initialization TFT T4, a first light-emitting enabling (or control) TFT T5, and a second light-emitting enabling (or control) TFT T6.

The pixel circuit PC includes the row scanning line 6 that transmits a first row scanning signal Sn to the switching TFT T2 and to the compensation TFT T3. The pixel circuit PC further includes the previous row scanning line 3 that transmits a second row scanning signal Sn−1, which is a previous row scanning signal, to the initialization TFT T4. It also includes the light-emitting control line 8 that transmits a light-emitting control signal En to the first light-emitting control TFT T5 and to the second light-emitting control TFT T6. It also includes the data line 4 that crosses the row scanning line 6 and transmits a data voltage Dm. Additionally included in the pixel circuit PC are the driving voltage line 7 that transmits the first power voltage ELVDD (and is formed almost parallel with the data line 4) and an initializing voltage line 5 that transmits an initializing voltage $V_{INT}$, which initializes the driving TFT T1 when Sn−1 is active.

A gate electrode G1 of the driving TFT T1 is connected to a first electrode C11 of a first capacitor C1. A source electrode S1 of the driving TFT T1 is connected to the driving voltage line 7 via the first light-emitting control TFT T5. A drain electrode D1 of the driving TFT T1 is electrically connected to an anode electrode of the main pixel light-emitting device $OLED_P$ via the second light-emitting control TFT T6. The driving TFT T1 receives the data voltage Dm according to a switching operation of the switching TFT T2, and supplies a driving current ($I_{OLED}$) to the pixel light-emitting device OLEDP (if the enable line 8 (En) is also active—meaning driven low for the case of PMOS transistors).

A gate electrode G2 of the switching TFT T2 is connected to the row scanning line 6. A source electrode S2 of the switching TFT T2 is connected to the data line 4. A drain electrode D2 of the switching TFT T2 is connected to the source electrode S1 of the driving TFT T1, and also connected to the driving voltage line 7 via the first light-emitting control TFT T5. The switching TFT T2 performs a switching operation such that the switching TFT T2 is turned on when an activating pulse is provided in the first row scanning signal Sn that is received via the row scanning line 6. The then turned-on switching TFT T2 transmits the data voltage Dm, which is transmitted to the data line 4, to the source electrode S1 of the driving TFT T1, where the latter transistor T1 has already been rendered conductive by the previous row scanning signal Sn−1.

A gate electrode G3 of the compensation TFT T3 is connected to the row scanning line 6. A source electrode S3 of the compensation TFT T3 is connected to the drain electrode D1 of the driving TFT T1, and connected to the anode electrode of the pixel light-emitting device $OLED_P$ via the second light-emitting control TFT T6. A drain electrode D3 of the compensation TFT T3 is connected to the first electrode C11 of the first capacitor C1, a drain electrode D4 of the initialization TFT T4, and the gate electrode G1 of the driving TFT T1. The compensation TFT T3 is turned on when an activating pulse is provided in the first row scanning signal Sn that is received via the row scanning line 6, and it then connects the gate electrode G1 and the drain electrode D1 of the driving TFT T1 to each other, and thus, causes the driving TFT T1 to then act as a diode.

A gate electrode G4 of the initialization TFT T4 is connected to the previous row scanning line 3. A source electrode S4 of the initialization TFT T4 is connected to the initializing voltage line 5. The drain electrode D4 of the initialization TFT T4 is connected to the first electrode C11 of the first capacitor C1, the drain electrode D3 of the compensation TFT T3, and the gate electrode G1 of the driving TFT T1. The initialization TFT T4 performs an initializing operation such that the initialization TFT T4 is turned when an activating pulse is provided in the second row scanning signal Sn−1 that is received via the previous row scanning line 3, and it then transmits the initializing voltage $V_{INT}$ to the gate electrode G1 of the driving TFT T1 and for storage in C1, and thus initializes a voltage of the gate electrode G1 of the driving TFT T1.

A gate electrode G5 of the first light-emitting control TFT T5 is connected to the light-emitting control line 8. A source electrode S5 of the first light-emitting control TFT T5 is connected to the driving voltage line 7. A drain electrode D5 of the first light-emitting control TFT T5 is connected to the source electrode S1 of the driving TFT T1 and the drain electrode D2 of the switching TFT T2.

A gate electrode G6 of the second light-emitting control TFT T6 is connected to the light-emitting control line 8. A source electrode S6 of the second light-emitting control TFT T6 is connected to the drain electrode D1 of the driving TFT T1 and the source electrode S3 of the compensation TFT T3. A drain electrode D6 of the second light-emitting control TFT T6 is electrically connected to the anode electrode of the pixel light-emitting device $OLED_P$. The first light-emitting control TFT T5 and the second light-emitting control TFT T6 are simultaneously turned on according to the light-emitting control signal En that is received via the light-emitting control line 8. Accordingly, drive current is transmitted to the pixel light-emitting device $OLED_P$, when the En line is active, and thus a driving current flows through the pixel light-emitting device $OLED_P$.

A second electrode C12 of the first capacitor C1 is connected to the driving voltage line 7. The first electrode C11 of the first capacitor C1 is connected to the gate electrode G1 of the driving TFT T1, the drain electrode D3 of the compensation TFT T3, and the drain electrode D4 of the initialization TFT T4.

A first electrode C21 of a second capacitor C2 is connected to the gate electrode G2 of the switching TFT T2. A second electrode C22 of the second capacitor C2 is connected to the drain electrode D3 of the compensation TFT T3.

Referring to FIG. 5, the pixel light-emitting device $OLED_P$ is an organic light-emitting device (OLED). The pixel light-emitting device $OLED_P$ includes a pixel electrode 31, an intermediate layer 33 that includes an organic emissive layer, and an opposite electrode 32. The pixel electrode 31 is an anode electrode, and is electrically connected to the pixel circuit PC. The opposite electrode 32 is a common electrode and a cathode electrode, and is connected to a second power voltage ELVSS. The pixel light-emitting device $OLED_P$ receives a driving current from the pixel circuit PC, and thus emits a corresponding amount of light. FIG. 5 shows a part of the organic light-emitting display apparatus of FIG. 2, taken along a line V-V, so as to illustrate the pixel light-emitting device $OLED_P$ in detail. Accordingly, of the pixel circuit PC, only a part of the drain electrode D6 and an active layer A6 of the second light-emitting control TFT T6, which is electrically connected to the pixel light-emitting device $OLED_P$, is illustrated in FIG. 5.

Referring to FIG. 2, the test pixel TP is disposed to correspond to the display pixel DP. That is, the test pixel TP is disposed to correspond to the there-denoted crossing point CP for which an erroneous voltage might be imposed on the Vint line (5) if the data line Dm (4) is there shorted to the Vint line. Operation of the exemplary test pixel TP is not dependent on proper operation of the Vint line (5). On the other hand, proper operation of the main pixel DP is dependent on proper operation of the Vint line (5). More generally, the test pixel TP is electrically connected to a plurality of lines other than one of the lines (e.g., the Vint line (5)) which may be rendered non-operational due to a short circuit at the corresponding crossing point CP. For example, the test pixel TP may be electrically connected to the data line 4 and the driving voltage line 7 but not the Vint line (5). The test pixel TP includes the test switching device Tt that is connected to a plurality of lines and is turned on if a short is generated at the crossing point CP such that the Vint voltage (e.g., −2.6V) is there imposed on the Dm line (4)—thereby turning test transistor Tt on. The test pixel unit TP further includes the test light-emitting device OLEDt that is connected to the test switching device Tt, and emits light if a short is generated at the crossing point CP (e.g., between the −2.6V signal carried on the Vint voltage line 5 and the Dm line which at the time of testing might be floated).

The test switching device Tt is a PMOS semiconductor transistor, and may be structurally a TFT. The test switching device Tt is included between the plurality of lines and the test light-emitting device OLEDt, and is turned on when a short is generated at the crossing point CP for which it is designed to test. Specifically, with regard to the test switching device Tt, a gate terminal Gt is connected to the data line 4 and a source terminal St is connected to the driving voltage line 7. A drain terminal Dt is connected to the test light-emitting device OLEDt. Referring to FIG. 7, the gate terminal Gt of the test switching device Tt is formed as one body with the data line 4 (Dm). Accordingly, the gate terminal Gt of the test switching device Tt is formed on the second insulating layer 15, and may be formed of the same material as the data line 4 in the same manufacturing process as that of the data line 4. In FIG. 7, the source terminal St and the drain terminal Dt of the test switching device Tt may correspond to both edges of an active layer 12.

In FIGS. 5 through 7, a reference numeral of the substrate is 10 and a reference numeral of a barrier layer, formed on the substrate 10, is 11. A reference numeral of a planarization layer that covers the test switching device Tt is 17. A reference numeral of a pixel-defining layer that defines a light-emitting area of the pixel light-emitting device $OLED_P$ is 19.

A brief description about driving of the test switching device Tt is described below.

If a short defect is not generated at the illustrated and exemplary crossing point CP, a data voltage Dm, which ranges from about 1.5 V to 4.0 V, is transmitted to the data line 4. In this case, the test switching device Tt, which is a PMOS transistor, is kept turned off by the positive range voltages present on the Dm line 4.

On the other hand, if a short circuit defect is generated at the illustrated and exemplary crossing point CP (of lines 4 and 5), the test switching device Tt is driven as described below. Before the data voltage Dm is applied to the data line 4, an initializing voltage $V_{INT}$ of about −2 V is applied to the initializing voltage line 5 in order to initialize the display pixel DP. Since the short defect is present in this case at the illustrated and exemplary crossing point CP, the negative initializing voltage $V_{INT}$ then flows through the data line 4. Accordingly, a negative voltage is applied to the gate terminal Gt of the test switching device Tt, and thus the test switching device Tt is turned on. If that particular test switching device Tt is turned on, a current that corresponds to the equation, shown below, is applied to the test light-emitting device OLEDt. In the equation shown below, $I_{OLED}$ is a driving current that is applied to the test light-emitting device OLEDt, and $V_{gs}$ is a difference between voltages of the gate terminal Gt and the source terminal of the test switching device Tt. $V_{th}$ is a threshold voltage of the test switching device Tt, and $V_{ELVDD}$ is a driving voltage level. $V_{INT}$ is an initializing voltage level.

$$I_{OLED} \propto \{V_{gs}-V_{th}\}=\{(V_{ELVDD}-V_{INT})-V_{th}\}=\{(4.6V-(-2))-V_{th}\} \quad \text{[Equation 1]}$$

The test light-emitting device OLEDt is an OLED. The test light-emitting device OLEDt includes a lower electrode 21, an interposing layer 23 that includes an organic emissive layer, and an upper electrode 22. The test light-emitting device OLEDt is formed simultaneously when the pixel light-emitting device $OLED_P$ is formed and of the same materials. Accordingly, a lithography process, which is performed by using a mask to define the main display pixel DP, is also simultaneously used to define the test pixel TP and additional lithography need not be further performed. Referring to all of FIGS. 5 and 7, the lower electrode 21 of the test light-emitting device OLEDt is formed of the same material, on the same layer, and at the same time as the pixel electrode 31 of the pixel light-emitting device $OLED_P$. Similarly, the upper electrode 22 of the test light-emitting device OLEDt is formed of the same material, on the same layer, and at the same time as the opposite electrode 32 of the pixel light-emitting device $OLED_P$. Particularly, the opposite electrode 32 of the pixel light-emitting device $OLED_P$ is a common electrode that is completely formed on the substrate 10. Thus, the upper electrode 22 may be regarded as a part of the opposite electrode 32. Accordingly, the upper electrode 22 is connected to the second power voltage ELVSS. The test light-emitting device OLEDt emits light immediately when its respective test switching device Tt is turned on. However, the present disclosure of invention is not limited to this specific example, and when a short circuit defect is detected, an appropriate and additional negative voltage, instead of the second power voltage ELVSS, may be applied to the upper electrode 22 during testing.

According to an embodiment of the present example, the interposing layer 23 of the test light-emitting device OLEDt and the intermediate layer 33 of the pixel light-emitting device $OLED_p$ may be identical to each other. For example, the interposing layer 23 and the intermediate layer 33 may identically include an organic common layer that includes a hole injection layer (HIL), a hole transmission layer (HTL), an electron transmission layer (ETL), and an electron injection layer (EIL), and an organic emissive layer that emits red, green, or blue light. In this case, the test light-emitting device OLEDt and the pixel light-emitting device $OLED_p$ may emit light of the same color. On the other hand, adjacent other pairs of test light-emitting devices OLEDt and main pixel light-emitting devices $OLED_p$ may emit respective lights of different colors.

In an alternate embodiment, the interposing layer 23 of the test light-emitting device OLEDt and the intermediate layer 33 of the pixel light-emitting device $OLED_p$ may be different from each other. For example, the intermediate layer 33 may include an organic common layer and a red organic emissive layer; however, the interposing layer 23 may include an organic common layer and a white organic emissive layer. In this case, the test light-emitting device OLEDt and the pixel light-emitting device $OLED_p$ may emit lights of different colors. When red, green and blue organic emissive layers are formed, if a mask, in which an area of the test light-emitting device Tt is always opened, is used, the test light-emitting device OLEDt may emit white light. As such, if the test light-emitting device OLEDt emits light of a color with a high visibility, for example, white light, a location of a short defect may be easily found.

The test switching device Tt and the test light-emitting device OLEDt may be disposed to overlap with each other. For example, the test switching device Tt may be disposed below the test light-emitting device OLEDt. Accordingly, an area of the display area DA, which is consumed by the test pixel TP, is minimized, and thus, an excessive reduction in an aperture ratio may be prevented.

Figure 8:
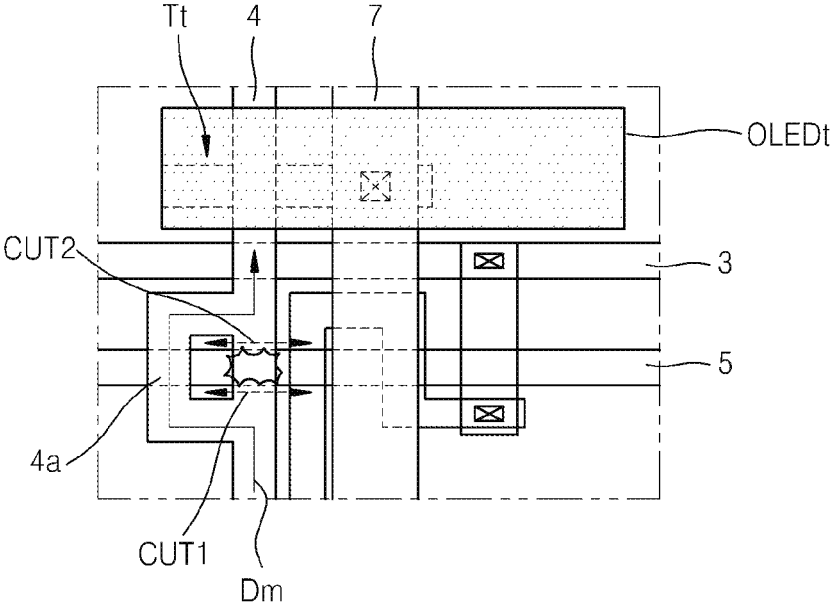
FIG. 8 is a plan view illustrating a method of repairing a main area shown in FIG. 2.

Hereinafter, referring to FIG. 8, a method of detecting and repairing a short defect at the illustrated and exemplary crossing point, with regard to the organic light-emitting display apparatus, is described. FIG. 8 is a schematic plan view illustrating a method of repairing a main area shown in FIG. 2.

In order to find a short defect at the crossing point CP, a negative initializing voltage $V_{INT}$ is transmitted to the initializing voltage line 5. As described above, the initializing voltage $V_{INT}$ may be a negative voltage of about −2 V. Referring to FIG. 2, the initializing voltage line 5 extends in a first direction, that is, an X-direction. A plurality of initializing voltage lines 5 are disposed in-line in the same number as the display pixels DP which are in a second direction, that is, a Y-direction. The initializing voltage $V_{INT}$ may be sequentially transmitted to the initializing voltage lines 5 that are arranged in the second direction. However, the present disclosure is not limited thereto, and the initializing voltages may be simultaneously transmitted to all the initializing voltage lines 5 that are disposed in the display area DA.

As illustrated in FIG. 8, if a short circuit defect is present at the illustrated and exemplary crossing point CP between the initializing voltage line 5 and the data line 4, the initializing voltage $V_{INT}$ will be transmitted via the short to the data line 4. Accordingly, the initializing voltage $V_{INT}$ will be applied to the gate terminal Gt of the test switching device Tt. As described above, the test switching device Tt is turned on by a negative voltage. Accordingly, a driving voltage, which corresponds to Equation 1 that is provided above, is applied to the test light-emitting device OLEDt, and thus, the test light-emitting device OLEDt emits light of magnitude which is brightest at the location closest to the place of the short circuit. That is, if a short is generated at the crossing point CP, the test light-emitting device OLEDt, which corresponds to the corresponding crossing point CP, emits light.

If a short defect is not present at the crossing point CP between the initializing voltage line 5 and the data line 4, the initializing voltage $V_{INT}$ is not transmitted to the data line 4. Accordingly, the test switching device Tt is maintained in a turned-off state, and thus, the test light-emitting device OLEDt does not emit light.

As such, by checking whether the test light-emitting device OLEDt emits light, it is determined whether a short defect is present at the crossing point CP.

Now, a method of repairing an organic light-emitting display apparatus, in a case that a short defect is present at the crossing point CP, is described.

A crossing point CP, which corresponds to a test light-emitting device OLEDt that emits light, is identified. That is, a crossing point CP, which is connected to the display pixel DP that corresponds to the test light-emitting device OLEDt, is identified. The crossing point CP may be identified visually or by using magnifying equipment such as a microscope and the identification may make use of a robot for automatically identifying presence and/or location of the short circuit.

Adjacent to the identified crossing point CP, there is the repairing line portion 4*a*, which is branched apart from the main data line 4, bypasses (circumvents around) the crossing point CP, and then, converges back to the main data line 4. A short defect at the crossing point CP is bypassed by ablating the main line portion disposed thereat and instead relying on the repairing line 4*a* portion to conduct the Dm signals.

In one embodiment, both of cut points or lines CUT1 and CUT2 are made to the data line 4, where the discovered short circuit point is disposed therebetween and symbolized by the jagged elliptical symbol. This process is performed so as to fully insulate the portion of the main data line 4 that crosses through the shorted crossing point CP from the rest of the main data line 4. The both points CUT1 and CUT2 may be cut by respectively exposing the both points CUT1 and CUT2 to a laser beam, a knife edge, or by other means.

When the cutting is complete, the data voltage Dm, which flows through the data line 4 when the cutting is not performed, bypasses the crossing point CP via the repairing line portion 4*a*. Thus, the short circuit defect at the crossing point CP is repaired.

According to an embodiment of the present disclosure of invention, a location of a defective line may be easily detected by employing a respective test pixel TP. Additionally, a repairing line is disposed at the corresponding crossing point, and thus, a defective line portion may be easily identified and repaired.

According to an embodiment of the present disclosure of invention, provided are an organic light-emitting display apparatus, in which a location of a defective line is easily detected and the defective line is easily repaired, and a method of repairing the same.

While the present disclosure of invention has been particularly shown and described with reference to an exemplary embodiment thereof, it will be understood by those of ordinary skill in the art in light of the foregoing that various changes in form and details may be made therein without departing from the spirit and scope of the present teachings.

What is claimed is:

1. An organic light-emitting display apparatus comprising:

a plurality of crossing lines including crossing pairs each crossing at least at a respective one crossing point and having an insulating layer portion interposed therebetween where a short circuit defect in the interposed insulating layer portion may occur at the respective one crossing point thereby shorting the corresponding crossing pair of lines one to the other at the respective one crossing point;

a plurality of pixel units each including a respective pixel circuit that is electrically coupled to respective ones the crossing lines and each including a respective pixel light-emitting device that is coupled to and driven by the respective pixel circuit, each pixel unit being disposed to correspond to at least a respective one of the crossing points, the pixel light-emitting device comprises a pixel electrode, a pixel intermediate layer that comprises an organic emissive layer, and an opposite electrode; and a plurality of test light-emitting devices each respectively disposed to correspond to an at least respective one crossing point of a respective one of the pixel units, the respective light-emitting device being electrically coupled to a subset of the plurality of the respective crossing lines of the respective pixel unit and being configured to emit light when a short circuit is present at the respective crossing point of that test light-emitting device, the test light-emitting device comprising a lower electrode that is formed of the same material and on the same layer as the pixel electrode, and an upper electrode that is formed of the same material and on the same layer as the opposite electrode.

2. The organic light-emitting display apparatus of claim 1, wherein the plurality of crossing pairs of crossing lines each respectively comprises:

a first line that extends in a first direction and is operatively coupled to transmit a negative voltage; and a second line that extends in a second direction which crosses the first direction, is formed in a different layer from the first line so as to overlap with the first line at the respective at least one crossing point, and is operatively coupled to transmit a positive voltage.

3. The organic light-emitting display apparatus of claim 2, wherein the first line transmits an initializing voltage that initializes the pixel circuit, and the second line transmits a data voltage in a range of data voltages including those sufficient to cause an emission of light from the respective pixel light-emitting device.

4. The organic light-emitting display apparatus of claim 2, wherein the second line comprises at each of its crossing points, a corresponding repairing line portion that is branched apart from the corresponding crossing point portion of the second line, the repairing line portion bypassing the corresponding crossing point and converging back to rejoin with the second line at a point spaced apart from the corresponding crossing point.

5. The organic light-emitting display apparatus of claim 4, wherein the first line is disposed on a first insulating layer that is formed on a substrate, and the second line is disposed on a second insulating layer that is formed on the first insulating layer to cover the first line.

6. The organic light-emitting display apparatus of claim 4, each of the plurality of test light-emitting devices is operatively coupled to a respective test switching device that is disposed adjacent to the corresponding crossing point and wherein the respective test switching device is turned on when a short is present at the corresponding crossing point.

7. The organic light-emitting display apparatus of claim 6, wherein the test switching device is a p-channel metal oxide semiconductor (PMOS) transistor in which a gate terminal is coupled to the second line, a source terminal is coupled to a driving voltage line, and a drain terminal is coupled to the test light-emitting device.

8. The organic light-emitting display apparatus of claim 7, wherein the gate terminal is formed as one body with the second line.

9. The organic light-emitting display apparatus of claim 7, wherein the test switching device and the corresponding test light-emitting device are disposed to overlap with each other.

10. The organic light-emitting display apparatus of claim 7, wherein the test switching device is turned on, when a short is present at the crossing point, and as a result of the short, the negative voltage is applied to the gate terminal.

11. The organic light-emitting display apparatus of claim 1, wherein the test light-emitting device is configured to emit light of a same color as that of its corresponding pixel light-emitting device.

12. The organic light-emitting display apparatus of claim 1, wherein the test light-emitting device is configured to emit light of a different color than that of its corresponding pixel light-emitting device.

13. The organic light-emitting display apparatus of claim 1, wherein an area of the test light-emitting device is smaller than an area of the corresponding pixel light-emitting device.

14. A method of testing and conditionally repairing an organic light-emitting display apparatus, wherein the organic light-emitting display apparatus comprises a first line that extends in a first direction, and a second line that extends in a second direction which crosses the first direction, is formed in a different layer from that of the first line to overlap with the first line at a crossing point, and comprises a repairing line portion that is branched from the second line before the crossing point, bypasses the crossing point, and converges back to rejoin the second line after the crossing point; a pixel that comprises a pixel circuit that is electrically coupled to the first line and the second line and a pixel light-emitting device that is coupled to the pixel circuit and driven by the pixel circuit, and is disposed to correspond to the crossing point; and a test light-emitting device that is electrically coupled to the first line and the second line via a test switching device and is disposed to correspond to the pixel, and is operatively coupled to emit light when a short is present at the crossing point, the method comprising:

transmitting an initializing voltage to the first line;

determining whether the test light-emitting device emits light, in response to determining that the test light-emitting device emits light, inspecting the corresponding crossing point to thereby determine whether the crossing point includes a short circuit; and in response to determining that the crossing point includes a short circuit, creating open circuits before and after the crossing point such that the short circuit at the crossing point is bypassed by the corresponding repairing line portion, wherein the pixel light-emitting device comprises a pixel electrode, a pixel intermediate layer that comprises an organic emissive layer, and an opposite electrode, and the test light-emitting device comprises a lower electrode that is formed of the same material and on the same layer as the pixel electrode, and an upper electrode that is formed of the same material and on the same layer as the opposite electrode.

15. The method of claim 14, wherein the initializing voltage is a negative voltage.

16. The method of claim 14, wherein the test switching device is turned on when a short circuit is present at the crossing point and the negative voltage is applied to a gate terminal of the test switching device as a result of the short circuit being present.

17. The method of claim 14, wherein the determining of whether the test light-emitting device emits light comprises:

turning on the test switching device in response to there being a short circuit at the crossing point;

emitting light, by the test light-emitting device that is coupled to the turned-on test switching device; and identifying the crossing point, which corresponds to the test light-emitting device that emits light.

18. The method of claim 14, wherein the creating of open circuits comprises cutting both points of the second line, with the shorted crossing point therebetween.

19. The method of claim 18, wherein the cutting is performed by exposing the both points of the second line to a laser beam.

* * * * *